United States Patent [19]

Cardwell et al.

[11] 3,951,647

[45] Apr. 20, 1976

[54] REDUCTION METHOD FOR PRODUCING MANGANESE METAL

[75] Inventors: Paul H. Cardwell, Zanoni, Va.; Bruce E. Barton, Houston, Tex.

[73] Assignee: Deepsea Ventures, Inc., Gloucester Point, Va.

[22] Filed: Nov. 27, 1972

[21] Appl. No.: 309,737

Related U.S. Application Data

[63] Continuation-in-part of Ser. No. 192,095, Oct. 26, 1971, abandoned.

[30] Foreign Application Priority Data

Oct. 26, 1972 Germany.....2252567

[52] U.S. Cl...... 75/80; 75/72; 75/77; 75/82; 423/495

[51] Int. Cl.[2]..... C22B 47/00

[58] Field of Search ..... 75/80, 77, 72, 82; 423/495, 72, 77, 82

[56] References Cited

UNITED STATES PATENTS

| | | | |
|---|---|---|---|
| 988,509 | 4/1911 | Rockey | 75/80 |
| 1,541,068 | 6/1925 | Pelzer et al. | 423/495 |
| 2,396,792 | 3/1946 | Kroll | 75/82 |
| 2,452,665 | 11/1948 | Kroll et al. | 75/63 |
| 3,615,359 | 10/1971 | Toth | 75/80 |

*Primary Examiner*—M. J. Andrews
*Attorney, Agent, or Firm*—Barry G. Magidoff

[57] ABSTRACT

A process is provided to produce pure elemental metal; such as manganese, by reacting a halide of the elemental metal with aluminum. The halide of the elemental metal is present as a molten pool wherein the temperature at the bottom of the pool is sufficient to maintain the elemental metal molten and the temperature at the top of the pool is below the boiling point of the metal halide in the pool. Aluminum halide is removed as a vapor overhead and a layer of molten metal collects at the bottom of the pool of molten halide.

15 Claims, 1 Drawing Figure

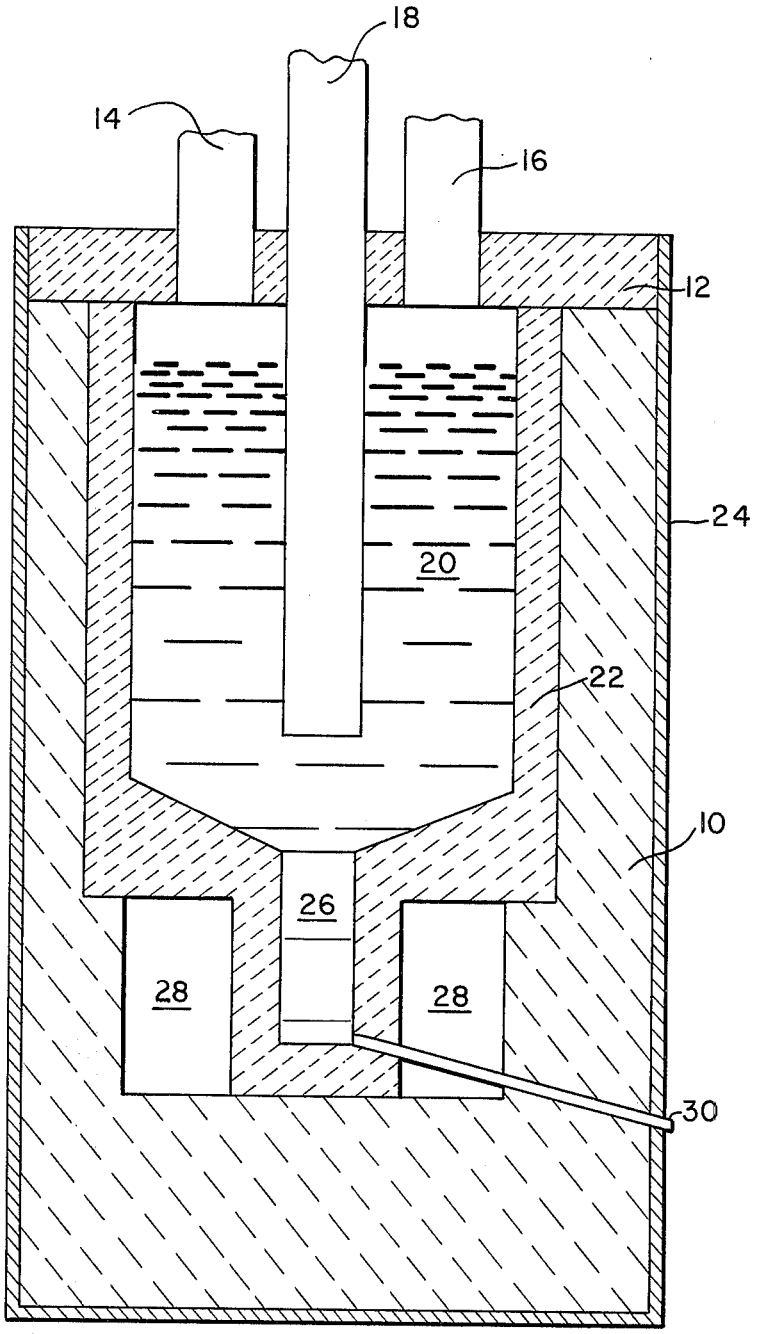
INVENTOR
PAUL H. CARDWELL
BRUCE E. BARTON
BY David H. Lemmer

REDUCTION METHOD FOR PRODUCING MANGANESE METAL

This application is a continuation-in-part of copending application Ser. No. 192095, filed Oct. 26, 1971 now abandoned.

Many non-ferrous metals are commercially produced at relatively low cost, but often in an insufficiently pure condition for many of their desirable uses. It thus often becomes necessary to go to substantial additional expense to purify the metal, which was obtained, for example, by reduction of compounds obtained from the refining of an ore. Manganese, for example, has some uses which are satisfied by a relatively low grade purity metal, e.g., in which the manganese can contain carbon, aluminum or iron. For other purposes, however, an extremely high purity material is required so that the presence of any of these materials would be detrimental. For other uses, only certain of the impurities impose a problem and the presence of other impurities is not detrimental. For example, manganese is useful as an alloy with iron. For such use the presence of even a relatively small percentage of carbon would be deleterious as it could have a significant effect upon the properties of the steel-manganese alloy to be formed. The presence of a small proportion of iron in the manganese would have substantially little or no effect on the final properties of such an alloy. Another factor is the condition of the metal obtained from the process. For example, there is often a requirement that the metal be in special form, e.g., in large chunks or ingots.

Manganese, for example, has been prepared by several methods; generally, by reducing the oxide to elemental metal. Such reduction has been carried out by displacing the manganese from the oxide using aluminum metal, by reducing using carbon, or by reductive electrolysis such as in a fused salt bath or in an aqueous solution. While aqueous electrolysis can result in the formation of extremely high purity metal, generally, it is very expensive and furthermore, normally results in the preparation of relatively thin sheets of the metal and not the large chunks of the metal which are more valuable economically. The reduction of the manganese oxide by contact at high temperatures with carbon or aluminum does result in a relatively large size chunk of the metal, but unfortunately, it does not result in a high purity product.

The electrolysis of an oxide of manganese in a fused salt bath can result in large chunks of metal and a relatively pure product, if great care is taken. The cost and difficulty of operating this procedure renders it somewhat uneconomical. See, for example, U.S. Pat. Nos. 2,398,589 and 3,018,233.

A similar problem is often found with many other metals which must be obtained in a relatively high degree of purity, such as copper, lead and nickel.

In accordance with the present invention, a process is provided wherein an elemental metal having a high degree of purity is obtained by the reduction of the halide of the metal with aluminum. This procedure is useful with metals which are non-reactive towards aluminum and which can be displaced by aluminum from its halide, such as copper, lead, nickel, cobalt and especially manganese. The halide of the metal to be reduced should have a boiling point higher than the melting point of aluminum and preferably not less than about 200°C. below the melting point of the metal to be reduced or, if one is formed, of a maximum melting point alloy of aluminum and the metal. It is further desirable that the halide of the metal to be reduced have a specific gravity lower than that of the metal or of aluminum. This process results in the formation of a high quality pure elemental metal which is initially obtained in the molten condition and, therefore, can be solidified into substantially any size ingot of the same high purity material.

The metal halides which are useful in the process of the present invention are the iodides, bromides and chlorides. The chlorides, being the most readily available, are preferred. Useful metal halides include manganese chloride, manganese bromide, manganese iodide, copper chloride, copper bromide, nickel bromide, nickel chloride and lead chloride.

Generally, the process comprises (1) contacting aluminum with the molten metal halide to form the corresponding aluminum halide and the metal; (2) vaporizing the aluminum halide, separating it from the molten metal halide and metal, while substantially preventing the loss by evaporation of the metal halide, and (3) separating the metal from the metal halide. Preferably, an excess of the metal halide is present during the reaction.

In the preferred embodiment of this procedure, the temperature conditions are set to maintain the metal product, the aluminum and the metal halide in the molten or semi-molten condition while they remain in contact with each other. This increases the reactivity of the aluminum and the metal halide. For example, manganese and aluminum readily form an alloy under the conditions of this process. This alloy, when solid, reacts very slowly, if at all, with the manganese halide. Accordingly, a commercially suitable procedure requires that the metals all be maintained in the molten condition. As the percentage of manganese in the alloy increases, i.e., as the aluminum displaces more manganese from the halide, the melting point of the alloy increases to a maximum greater than the melting point of pure manganese, i.e., the alloy of manganese and aluminum form a maximum melting point alloy. It is thus necessary to maintain the maximum temperature of the molten reaction mixture at the maximum alloy melting point, i.e., at a temperature greater than that of the melting point of pure manganese.

The method by which the temperature is maintained depends upon the procedure by which the process is carried out, i.e., batch or continuous, and the composition of the reaction mixture. In a batch process, for example, the temperature of the metal halide when the aluminum is first added is at last at the melting point of the halide. Preferably, the initial temperature should be at or above the melting point of aluminum, as well.

The aluminum is admixed with the metal halide and the temperature is gradually increased as the aluminum reacts with the metal halide to form the aluminum halide, which immediately vaporizes, and the elemental metal which immediately forms an alloy with the remaining aluminum. The final temperature must be sufficiently great to maintain the pure metal or any high melting point alloy in a molten condition. Generally, for example, when utilizing manganese as a metal, the final temperature is at least about 1300°C., but preferably not above about 1500°C. The loss of the metal halide, e.g., manganese halide, as a result of evaporation at the end of the procedure is kept relatively low by only slowly increasing temperatures and maintaining a temperature gradient so that the temperature of the halide is below its boiling point.

Further, if desired, the pressure above the mixture can be increased to at least decrease the extent of evaporation of the metal halide without substantially decreasing the evaporation rate of aluminum halide, which boils at a far lower temperature.

Cobalt metal can be displaced from its halide by aluminum in accordance with this invention. However, cobalt halides e.g. cobalt chloride, sublimes at atmospheric pressure. A molten pool comprising cobalt halide can be maintained, however, by admixing the cobalt halide with an alkali metal halide and/or an alkaline earth metal halide, for example.

In the preferred continuous processe, the evaporation of the metal halide can be substantially eliminated by utilizing a pool of the molten metal halide having a temperature gradient, the temperature increasing from the top to the bottom of the pool. The upper portion of the pool must be at least at the melting point for the metal halide. The temperature increases downwardly through the molten pool so that at the bottom of the pool the temperature can be greater than the boiling point of the metal halide. However, the net evaporation of the metal halide from the pool is substantially nil: any boiling, or ebullition, which may occur at the bottom of the pool condenses and disappears as it rises through the pool; the vapor does not pass the cooler upper surface of the molten pool.

In a continuous process aluminum metal is added to a molten pool of the metal halide. The aluminum metal can be added at the top of the pool; the aluminum begins to melt and to displace the metal from the halide as it sinks into the pool of molten metal halide. The mixed or alloyed elemental displacable metal and aluminum sinks through the pool of molten metal halide. The aluminum halide formed immediately evaporates and bubbles up and is permitted to be dispersed from the top of the metal. As the aluminum sinks and melts it reacts with additional metal halide, displacing additional metal, which in most cases forms an alloy with the aluminum while this reaction is progressing.

The alloy formed between aluminum and the displacable metal is generally of a much higher density than is aluminum metal. Therefore, the alloy does eventually sink into the molten metal halide even if the density of the halide is greater than that of the pure aluminum metal, after some displacement and resultant alloying has occurred. The aluminum is gradually depleted from the alloy as the reaction progresses.

A molten pool of mixed, or alloyed, displacable metal and aluminum is formed below the molten metal halide. The pool of elemental metal at the bottom contains some aluminum, which continues to react with the metal halide at the interface of the two layers. Thus, in a continuous procedure, the residence time of the aluminum in the reaction vessel determines the ultimate average composition of the molten metal pool at the bottom. Generally, the molten metal is not miscible with the molten metal. The pool of molten metal is stirred by convection currents formed within the pool of metal, which increases the rate of the reaction. If desired, external stirring means can be applied, including the use of a mechanical stirrer or by the injection of inert gas such as any of the Noble gases, i.e., helium, argon, neon and xenon into and through the molten metal.

If desired, at least a portion of the aluminum can be added to the lower portion of the pool of metal halide, thus not permitting any exothermic displacement reaction to occur in the upper portion of the pool. This can aid in the maintenance of the temperature gradient in the pool. During steady-state operation of this process, the exothermic displacement reaction of aluminum and the metal halide is self-sustaining and the temperature is determined by the amount of aluminum reacted, which is controlled by the rate of aluminum addition.

It has further been found that the extent of the temperature gradient between the bottom and top of the molten metal halide pool can be decreased or eliminated by increasing the boiling point of the metal halide. Often the boiling point can be increased to above the melting point of the metal or of a high melting aluminum alloy, by the addition of certain diluents or impurities. These impurities are inert to aluminum, the metal and the metal halide and substantially do not affect the displacement reaction of aluminum with the metal halide. Especially suitable materials are the high boiling point, stable halides of the alkali metals and alkaline earth metals.

In many cases, these boiling point increasing diluents are found as impurities in the metal halide feed. For example, in the manganese halide which is obtained from the refining of ocean floor nodule ores, such as for example, is described in German Pat. No. 2,126,175 substantial proportions of sodium chloride magnesium chloride, potassium chloride, lithium chloride and calcium chloride are present. In a relatively short period of continuous operation, the proportion of these impurities in the molten manganese halide pool can approach 50%. For example, the boiling point of manganese chloride containing 50% by weight of the total salt mixture of a mixture of alkali and alkaline earth metal halides is substantially above the melting point of manganese metal or manganese-aluminum alloy (about 1300°C.). Therefore, the problem of the boiling of the metal halide is avoided without requiring the maintenance of a temperature gradient.

When carrying out this procedure it is desirable to have present not more than about 90 percent by weight of the total salt mixture of any such impurity. Preferably, however, not more than about 60 percent by weight of the impurity is present. Any amount of such an impurity increases the boiling point, the amount which is optimum is that just sufficient to increase the boiling point of the metal halide to above the melting points of the metals.

A preferred procedure for carrying out the process of this invention is a continuous procedure wherein a charge of the metal halide is heated by an external source, e.g., gas burner or electric coil, to form a molten pool. The heat is generally applied to the bottom portion of the charge so as to create a temperature gradient between the lower and the upper portion of the resulting molten pool. The temperature at the top of the pool must be just sufficient to melt the metal halide. It is therefore desirable to avoid any stirring action in the metal halide pool.

Aluminum metal and additional metal halide are then added, preferably in particulate form, to the molten bath; the aluminum melts substantially as soon as it contacts the molten halide. The exothermic displacement reaction between aluminum and the metal halide is sufficient to maintain the temperature of the reaction mass; the rate of aluminum addition is controlled to determine the temperature of the melt during the process. If the rate at which manganese metal is formed is desired to be increased, the upper portion of the molten metal halide pool must be cooled, e.g., by removing additional insulation or, if necessary, adding external cooling means. Generally, in order to maintain the pool of metal halide during a continuous process, substantially stoichiometric quantities of the aluminum and the metal halide are added to the metal halide melt. These proportions, of course, can be varied as desired. However, generally the addition of excess metal halide would result in a gradual buildup of the halide in the reactor vessel.

The aluminum halide by-product is vaporized and evolved from the upper surface of the molten pool to be withdrawn overhead. Preferably, when initiating the reaction a blanket of inert gas, such as nitrogen or any of the Noble gases is present. However, as the aluminum halide is evolved the inert gas is gradually removed with the aluminum halide vapor and during steady-state operation of the continuous reactor a blanket of aluminum halide atmosphere remains above the melt. In any event, the atmosphere should be substantially free of oxygen and both the aluminum metal and the metal halide should be substantially free of the oxide. The presence of oxygen results in the formation of a slag and of an aluminum oxide impurity in the product; this should be avoided.

As the reaction progresses, there is a gradual buildup of molten metal at the bottom of the reaction vessel. The metal can be tapped at a rate to maintain a residence time in the reaction vessel sufficient to form a layer of molten metal at the bottom of the pool substantially depleted in aluminum. The total residence time is a factor not only of temperature and the condition of the aluminum metal, but also of the height of the pool, which determines the time during which the aluminum falls through the pool of metal halide. The period during which the aluminum falls is the period of greatest reaction efficiency. Therefore tall narrow pools of the molten metal halide are more efficient than short wide pools of equal volume. Similarly, the greater the density of the metal halide, the longer is the period of fall. The maximum residence time is determined by economic considerations only, the longer the time the less aluminum remaining.

The aluminum halide evaporated from the molten bath and drawn off is preferably passed over the aluminum metal prior to its being injected into the molten bath. This permits the recovery of any metal halide which may have been carried by the aluminum halide.

The drawing is a cutaway elevation view of the reactor vessel suitable, for example, for use in the displacement of manganese from manganese halide by aluminum.

As shown, the reactor is a crucible having two solid inlets 16 and 18 and one vapor outlet 14 at the top. The lower portion of the crucible is formed as a relatively narrow neck 26 from which a liquid outlet port 30 is provided. The neck 26 is coaxial with the larger portion of the crucible 20. A bleed line 23 is provided from the upper portion of the crucible.

The aluminum metal inlet 18 can extend to below the level of the melt, as shown by dashed lines, to provide an inlet conduit designated by the numeral 18*a*.

Heating elements are positioned within the chamber 28, formed as an annulus around the narrow portion 26 of the reaction vessel.

The entire crucible is lined with a high temperature-resistant, inert material 22 and 12, such as high purity alumina in brick or solid sheet form, or high purity zirconia, brick or sheet. Any insulating material which is inert to the reaction mixture, and which will not interfere with the reaction of this process or introduce any impurities into the metal product can be utilized.

The aluminum feed conduit, 18*a*, projecting into the body of the molten pool must be formed of a material which is resistant to high temperature, which is non-reactive with the molten metal halide and which does not introduce any impurities into the metal. Such materials include, for example, high-temperature alumina and zirconia.

The outlet line for the molten metal and the bleed line for the molten metal halide are conventional in the art. Basically, such ports include an outlet which is stopped by a removable plug of refractory material. The molten material can be removed continuously or intermittently as desired in a continuous process. Designs for such outlets are well known in the art. See, for example, U.S. Pat. Nos. 3,018,233 and 2,309,598.

The crucible is preferably surrounded by additional insulating layers 10, which can be comprised of insulating brick positioned, for example, within a steel shell, 24.

Any heat source can be used in chamber 28. Gas jets or electrical coils are useful. Alternatively, heating coils may be positioned within the reactor vessel, 26, or heating electrodes placed flush with the walls 22.

During operation of the process in the apparatus shown in the drawing, a liquid melt of the metal halide is present in the upper portion of the reactor vessel 20, and a molten metal layer is formed within the narrow portion 26. Preferably, the phase boundary between the molten metal and the molten metal halide is at or near the top of the narrow portion 26. This permits the greatest effective temperature gradient such that the temperature within 26 can be maintained at a relatively high temperature, e.g., greater than 1300°C., whereas the pool of metal halide can have a relatively steep temperature gradient quickly cooling to below the boiling point of the metal halide.

The aluminum halide which evaporates from the melt passes upwardly through vapor outlet 14 is passed in contact with the aluminum metal prior to its entering the reactor through inlet 18. Such contact can be made by passing the vapor and aluminum metal countercurrently such as through a vertical or horizontal bed of the aluminum metal.

The aluminum is preferably added in particulate form, preferably in particles not larger than about 4 inches. However, the particle size is not crucial to the process; the smaller the particle size the greater the initial surface area exposed to the melt upon the addition of the aluminum. Similarly, the metal halide is preferably added in particulate form of a particle size not larger than about ¼ inch. This is also not crucial, however.

The aluminum metal prior to addition to the reactor is preferably free of aluminum oxide film. If any aluminum oxide is present, the concentration of such impurity in the reaction vessel can be limited by utilizing a continuous bleed from the metal halide melt. Such bleed can, in addition, restrict any impurities which may be added, for example, as impurities in the metal halide feed, as explained above. Thus, the ratio of bleed rate to metal halide addition rate can also be maintained in order to maintain a constant volume in the reactor vessel and to maintain a constant concentration of reactant metal halide and any impurities. Optimally, however, the feed is substantially free of oxides.

The following example describes preferred embodiment of the present invention but is not to be exclusive of the scope thereof.

EXAMPLE 1

A sample, 1000 grams, of anhydrous manganese chloride ($MnCl_2$) was placed in a closed reactor lined with high purity alumina brick (98.8% $Al_2O_3$). The reactor was provided with an alumina-lined cover having a vapor outlet connected to a vertical column and then to a condenser, an aluminum metal inlet connected to the tower, and a metal halide inlet. The reactor was heated by an external electrical heating coil around the bottom of the reactor. The lower portion of the reactor was heated to about 1250°C. while the upper portion of the reactor was maintained at 1150°C. The pool of molten metal halide was approximately 2 inches deep.

The atmosphere above the manganese halide was cleared of air and a blanket of nitrogen gas maintained.

Aluminum turnings at a rate of one gram per minute were added for a period of 25 minutes to the molten manganese chloride. Additional particulate manganese halide was added simultaneously with the aluminum at a rate of 40 grams per minute. The temperature of the manganese chloride at the top surface increased from 1150°to 1180°C. upon the addition of the aluminum metal and remained at that temperature. The temperature at the bottom portion of the reactor vessel was increased to about 1300°C.

Aluminum chloride vapor was vented through the vapor outlet line and passed countercurrently to the aluminum in the tower before being added to the reactor vessel. Approximately 60 minutes after the initial addition of the aluminum turnings, manganese metal was withdrawn from the bottom of the reactor vessel. No detectable amounts of aluminum were found in the manganese metal (minimum detectable level for the test, 0.05 percent aluminum by weight).

The patentable embodiments of the invention which are claimed are:

1. A process for producing manganese within a reactor vessel, the process comprising: (1) forming a molten pool comprising a manganese halide, selected from the group consisitng of manganese iodides, manganese bromides and manganese chlorides, in a reactor vessel such that the upper portion of the molten pool is at a temperature above the melting point of the manganese halide in the pool but below the boiling point of the metal halide in the pool, and the temperature of the lower portion of the molten pool is sufficient to maintain aluminum metal, manganese metal and any alloy of the two metals in a molten state, the boiling point of the pure manganese halide being below the temperature of the lower portion of the pool, there being a temperature gradient maintained in the molten pool, the temperature increasing from top to bottom; (2) feeding to the molten pool in substantially stoichiometric proportions additional manganese metal halide and aluminum to form aluminum halide and manganese metal in the pool; (3) removing the aluminum halide as a vapor overhead from the top of the reactor vessel; (4) forming a layer of molten elemental manganese metal at the bottom of the molten pool; and (5) withdrawing elemental manganese metal from the bottom of the pool.

2. A method for producing elemental manganese, the process comprising: (1) Forming a molten pool comprising a manganese halide selected from the group consisting of manganese chlorides, manganese bromides and manganese iodides admixed with a diluent which increases the boiling point of the manganese halide to above the temperature of the molten pool; (2) contacting the molten manganese halide with aluminum metal to form aluminum halide vapor and molten manganese metal layer at the bottom of the pool, and (3) withdrawing the aluminum halide vapor from the molten manganese halide and elemental manganese and separating the elemental manganese from the manganese halide.

3. The method of claim 2 wherein the diluent is selected from the group consisting of alkali metal halides and alkaline earth metal halides.

4. The method of claim 2 wherein the temperature of the molten pool is at least about 1300°C.

5. The method of claim 4 wherein the halides are chlorides.

6. The process of claim 2 wherein the pool of molten manganese at the bottom of the reactor is substantially free of aluminum.

7. The process of claim 2 wherein a substantially inert atmosphere is maintained above the pool of molten metal halide.

8. The process of claim 2 wherein the upper portion of the molten pool is at a temperature above the melting point of aluminum metal.

9. A method for producing elemental manganese, the process comprising: (1) Forming a molten pool comprising a manganese halide selected from the group consisting of manganese chlorides, manganese bromides and manganese iodides admixed with a diluent which increases the boiling point of the manganese halide to above the melting point of the elemental manganese metal; (2) contacting the molten manganese halide with aluminum metal to form aluminum halide vapor and molten manganese metal layer at the bottom of the pool, while maintaining the temperature of the pool such that the top portion of the pool is below the boiling point of the manganese halide in the pool, thereby substantially preventing the loss by evaporation of the manganese halide; (3) withdrawing the aluminum halide vapor from the molten manganese halide and elemental manganese and separating the elemental manganese from the manganese halide.

10. The process of claim 9, wherein the temperature in the lower portion of the molten pool is sufficient to maintain the manganese halide, elemental aluminum, elemental manganese, and any alloy of aluminum and the elemental manganese in molten form.

11. The process of claim 10 wherein the withdrawn aluminum halide vapor is contacted with the aluminum prior to the addition of the aluminum to the molten pool to recover any manganese halide present in the vapor.

12. The process of claim 10 wherein a temperature gradient is maintained vertically through the depth of the pool such that the temperature increases from the top to the bottom of the pool.

13. The process of claim 12 wherein the aluminum is added to the molten pool of the manganese halide and additional manganese halide is added to the pool simultaneously with the aluminum, substantially in stoichiometric proportions.

14. The process of claim 13 wherein the temperature of the molten pool is in the range of from about 700° to about 1500°C.

15. The process of claim 14 wherein the manganese halide is manganese chloride.

* * * * *